US012342964B2

(12) United States Patent
Wolter et al.

(10) Patent No.: US 12,342,964 B2
(45) Date of Patent: Jul. 1, 2025

(54) DEVICE FOR MOUNTING A SANITARY COMPONENT TO A WALL

(71) Applicant: Grohe AG, Hemer (DE)

(72) Inventors: Mirco Wolter, Welver (DE); Hartwig Philipps, Menden (DE); Thomas Vorel, Arnsberg (DE)

(73) Assignee: GROHE AG, Hemer (DE)

( * ) Notice: Subject to any disclaimer, the term of this patent is extended or adjusted under 35 U.S.C. 154(b) by 0 days.

(21) Appl. No.: 18/279,256

(22) PCT Filed: Mar. 9, 2022

(86) PCT No.: PCT/EP2022/056054

§ 371 (c)(1),
(2) Date: Aug. 29, 2023

(87) PCT Pub. No.: WO2022/194642

PCT Pub. Date: Sep. 22, 2022

(65) Prior Publication Data

US 2024/0138632 A1 May 2, 2024

(30) Foreign Application Priority Data

Mar. 15, 2021 (DE) ..... 102021106203.9

(51) Int. Cl.
*A47K 10/10* (2006.01)

(52) U.S. Cl.
CPC ..... *A47K 10/10* (2013.01); *A47K 2201/02* (2013.01)

(58) Field of Classification Search
CPC ..... A47K 10/10; A47K 2201/02
See application file for complete search history.

(56) References Cited

U.S. PATENT DOCUMENTS

| | | | | |
|---|---|---|---|---|
| 5,071,099 | A | 12/1991 | Kuo | |
| 5,108,819 | A * | 4/1992 | Heller | H01L 23/145 428/209 |
| 5,323,993 | A * | 6/1994 | Questel | B29C 45/14778 248/467 |
| 5,403,700 | A * | 4/1995 | Heller | H01L 23/4985 430/311 |
| 5,593,120 | A * | 1/1997 | Hamerski | F16B 11/006 156/73.5 |
| 10,827,885 | B2 * | 11/2020 | Said | B65D 83/0835 |
| 2005/0012002 | A1 * | 1/2005 | Ortwein | F16B 37/048 248/205.3 |
| 2005/0112314 | A1 * | 5/2005 | Hamilton | C09J 7/22 428/40.1 |

(Continued)

FOREIGN PATENT DOCUMENTS

| | | |
|---|---|---|
| CN | 206221484 | 6/2017 |
| EP | 0442674 | 3/1996 |

OTHER PUBLICATIONS

International Search Report dated Mar. 9, 2022 in International (PCT) Application No. PCT/EP2022/056054.

*Primary Examiner* — Anita M King
(74) *Attorney, Agent, or Firm* — Wenderoth, Lind & Ponack, L.L.P.

(57) ABSTRACT

A device (1) for mounting a sanitary component to a wall (8) having at least: a mounting plate (2), which consists at least partially of plastic and has an adherend (3) for mounting the device (1) to the wall (8); and a metal coating (4), which is formed at least partially on a surface (5) of the adherend (3).

12 Claims, 1 Drawing Sheet

(56) References Cited

U.S. PATENT DOCUMENTS

Figure 1:
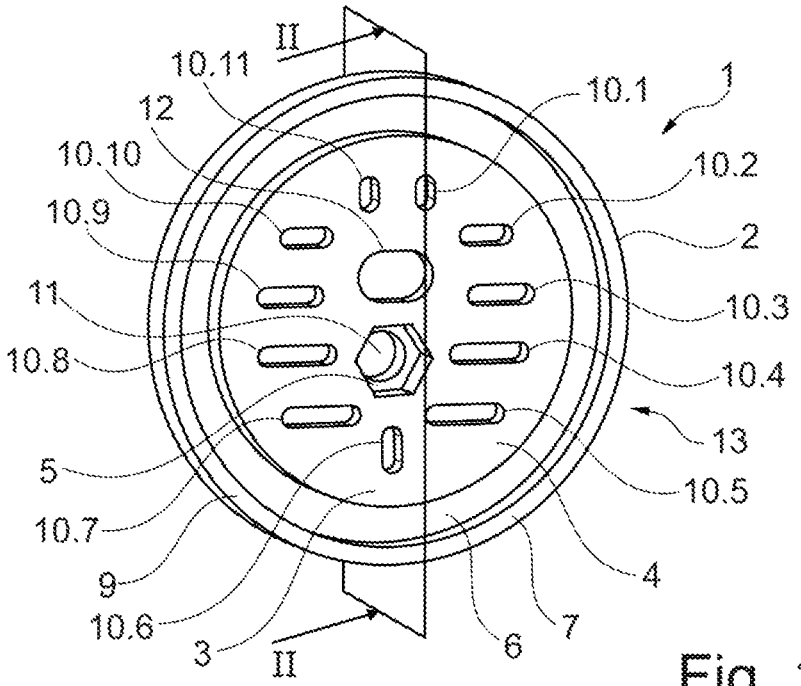

| | | | | |
|---|---|---|---|---|
| 2011/0167746 | A1* | 7/2011 | Scalise | A47K 3/281<br>52/391 |
| 2014/0084118 | A1* | 3/2014 | Tooley | F16B 11/00<br>248/205.3 |
| 2016/0157680 | A1* | 6/2016 | Gucciardo | A47K 3/003<br>52/27 |
| 2019/0161965 | A1* | 5/2019 | Persson | F16B 47/003 |

* cited by examiner

DEVICE FOR MOUNTING A SANITARY COMPONENT TO A WALL

The present invention relates to a device for mounting a sanitary component to a wall. Such devices can be used in particular to mount sanitary components, for instance shower rails, tower racks or soap dispensers, to the walls of sanitary facilities.

Known devices for mounting sanitary components are routinely mounted to walls with screws. A known issue are tiled walls in sanitary rooms, which tiles can be damaged by the screw connections. Furthermore, the attachment of mounting devices with adhesive tape or glue is known, which can prevent damage to the tiles. The disadvantage thereof is, however, that the bonding often does not achieve the required durability.

Therefore, the invention addresses the problem of at least partially solving the problems described with respect to the prior art and, in particular, specifying a device for mounting a sanitary component to a wall, by means of which high durability can be achieved.

This problem is solved with a device according to the features of the independent claim. Further advantageous embodiments of the device are specified in the dependent claims. It will be appreciated that the features listed individually in the dependent claims may be combined in any technologically useful manner and define further embodiments of the invention. In addition, the features indicated in the claims are further specified and explained in the description, wherein further preferred embodiments of the invention are illustrated.

A device for mounting a sanitary component to a wall, comprising at least the following, contributes to solving the problem:

- a mounting plate, which consists at least partially of plastic and an adherend for mounting the device to the wall; and
- a metal coating, which is formed at least partially on a surface of the adherend.

In particular, the device is used to mount a sanitary component to a wall. Such a sanitary component may be, for instance a shower rail, towel rack, soap dispenser, paper holder, toilet brush set, etc. The device may be a separate component, to which the sanitary component can be mounted. Furthermore, however, the device can also be formed integrally with the sanitary component.

The device has a mounting plate, which can be designed, for instance, in the manner of a mounting bracket. Furthermore, the mounting plate may have a circular cross-section, in particular orthogonal to a central axis or longitudinal axis of the mounting plate. Furthermore, the mounting plate may have a diameter of for instance 10 mm to 100 mm, in particular orthogonal to the central axis or longitudinal axis, and/or a length of 2 mm to 30 mm, in particular parallel to the central axis or longitudinal axis. The mounting plate consists at least partially or completely of plastic. The plastic can for instance be a galvanically coatable plastic, polyamide (PA), acrylonitrile butadiene styrene copolymer (ABS) or a glass fiber reinforced plastic. Furthermore, the mounting plate may be a plastic injection molded part. As a result, a high design flexibility of the mounting plate can be achieved at low cost.

The mounting plate has an adherend for mounting the device to the wall. In particular, the adherend is a surface of the mounting plate, to which an adhesive can be applied for mounting the device to the wall. Thus, the adherend may be in particular, a non-self-adhesive area. The adhesive may be, for instance, a single-component adhesive, two-component adhesive or a multi-component adhesive. In particular, the adhesive can be applied to the adherend before the mounting plate is pressed against the wall. As an alternative, the adhesive can also be injected into the gap and/or onto the adherend via an opening in the mounting plate. The adherend extends in particular orthogonally to the central axis or longitudinal axis of the mounting plate. Furthermore, the adherend can be round and/or have an adherend diameter of for instance 9 mm to 99 mm [millimeters].

A surface of the adherend has at least partially a metal coating. In particular, the surface of the adherend is completely coated with the coating. Furthermore, the entire mounting plate can be coated with the coating. The coating can be provided at least partially between the mounting plate and an adhesive applied to the adherend. The coating can be a galvanic coating, which in particular, can be generated by an electrochemical deposition in an electrolytic bath. Furthermore, the coating can be generated and/or finished using physical vapor deposition (PVD). In particular, a surface roughness can be increased by means of physical vapor deposition. For instance, the coating can be a chrome coating and/or a copper coating. In particular, the coating increases an adhesive force between the mounting plate and the adhesive, so that a high durability of the device on the wall can be achieved.

The coating can have a coating thickness of 5 μm (micrometers) to 100 μm. Preferably the coating can have a coating thickness of 15 μm to 35 μm.

The adherend can be at least partially enclosed by a groove. In particular, the groove can be annular and/or the adherend can be completely enclosed. In particular, excess adhesive can be absorbed by the groove. Furthermore, the groove can have a groove width of for instance 1 mm to 5 mm and/or a groove depth of 1 mm to 5 mm.

The mounting plate can have at least one contact surface for the wall, with which the adherend can be positioned at a distance from the wall. In particular, the contact surface is a surface with which the mounting plate contacts the wall after its installation. The contact surface is in particular designed such that a gap for the adhesive is formed between the adherend and the wall. The adherend can be embodied in the mounting plate, in particular, parallel to the central axis or longitudinal axis of the mounting plate, for instance at a distance of 0.3 mm to 2 mm to the contact surface. As a result of this, a gap can be generated with a gap width of 0.3 mm to 2 mm between the adherend and the wall. Furthermore, the adherend and the contact surface can extend parallel to each other. In addition, the contact surface can be annular.

The contact surface can have at least one adhesive agent for pre-attaching the device to the wall. For instance, the at least one adhesive agent can be an adhesive film, which attaches the mounting plate to the wall, before the adhesive has cured. Furthermore, the adhesive film can be circumferential, annular, ring segment-shaped, rectangular and/or point-shaped.

The adherend can have a plurality of vent openings. In particular, in the mounting of the mounting plate to the wall the adhesive can be ventilated via the vent openings, so that said adhesive can cure, for instance due to the humidity of ambient air. The vent openings can for instance be embodied in the manner of drilled holes and/or extend parallel to the central axis or longitudinal axis through the mounting plate. Furthermore, the vent openings can be embodied in the manner of oblong holes.

The plurality of vent openings can extend over an area of 5% to 30% of the adherend. In other words, this can mean that 5% to 30% of a total area of the adherend vent openings has or is formed by vent openings. In particular, the total area is an area of the adherend which the adherend would have without the vent openings. In addition, cross-sectional areas of the vent openings can have an area corresponding in total to 5% to 30% of the adherend or of the total area of the adherend.

In addition, provision can be made that no point on the adherend has a distance greater than 4 mm, preferably more than 2 mm, from the plurality of vent openings. In other words, this can mean that at no point of the adherend is there a distance greater than 4 mm, preferably more than 2 mm, from the plurality of vent openings. In addition, provision can be made that the vent openings have a maximum distance of 4 mm from one another. This ensures that the adhesive in the gap can completely cure.

The adherend can have at least one first mounting opening for the sanitary component. The at least one first mounting opening can for instance be embodied in the manner of a drilled hole and/or extend parallel to the central axis or longitudinal axis through the mounting plate. In particular, the sanitary component can be mounted to the mounting plate via the at least one mounting opening. To this end, the at least one mounting opening can for instance have a thread. Furthermore, the at least one mounting opening can have a hexagon socket for a nut and/or a bolt head.

The adherend can have at least one second mounting opening for mounting the device to the wall. The at least one second mounting opening can for instance be embodied in the manner of a drilled hole and/or extend parallel to the central axis or longitudinal axis through the mounting plate. Furthermore, the at least one second mounting opening can be embodied in the manner of an oblong hole. In particular, the mounting plate can be mounted to the wall via the at least one mounting opening, for instance with the aid of a screw and/or a dowel. As a result of this, the durability of the mounting plate to the wall can be further increased.

According to another aspect, the use of a device disclosed here for securely and/or easily mounting a sanitary component to a wall (without damaging the wall) by means of an adhesive is proposed. The explanations relating to the device and its usage can also be used to characterize its use.

The invention and the technical environment are explained in more detail below with reference to the figures. It should be noted that the figures show a particularly preferred variant of the embodiment of the invention, but the invention is not limited thereto. The same reference numerals are used for the same components in the figures. Schematically:

FIG. 1: shows a perspective view of the device; and

Figure 2:
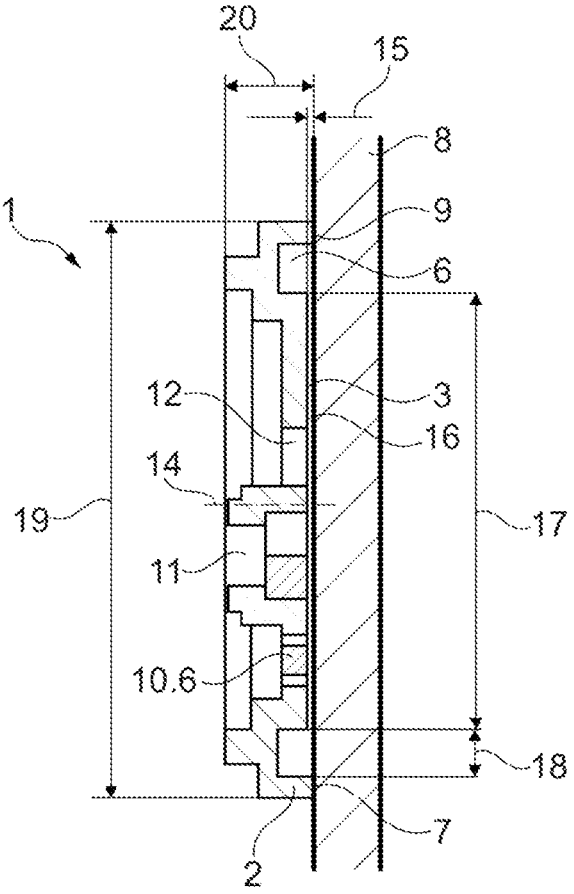

FIG. 2: shows the device on a wall in a longitudinal section.

FIG. 1 shows a perspective view of the device 1. The device 1 comprises a mounting plate 2, which is embodied in the manner of a round mounting disk. The mounting plate 2 consists of plastic and is completely coated with a metal coating 4. Furthermore, the mounting plate 2 has a round adherend 3 on an end face 13, which is enclosed by an annular groove 6. The groove 6 in turn, is enclosed by an annular contact surface 7 for a wall 8 shown in FIG. 2. The contact surface 7 has an adhesive agent 9 for pre-attaching the device 1 to the wall 8 shown in FIG. 2. In the embodiment variant shown here the adherend 3 has eleven vent openings 10.1, . . . , 10.11. The vent openings 10.1, . . . , 10.11 are each embodied in the manner of oblong holes. In addition, the adherend 3 has a first mounting opening 11 for a sanitary component not shown here. The first mounting opening 11 comprises a hexagon socket 5 for a nut not shown here or a bolt head of a mounting bolt not shown here. In addition, the adherend 3 has a second mounting opening 12, which can be additionally mounted on the wall 8 shown in FIG. 2 via the mounting plate 2 using a screw. The second mounting opening 12 is likewise embodied in the manner of an oblong hole.

FIG. 2 shows the device 1 in a longitudinal section along the sectional plane II-II shown in FIG. 1 after the mounting plate 2 has been mounted to the wall 8. The mounting plate 2 contacts the wall 8 with its contact surface 7. The mounting plate 2 is pre-attached to the wall by the adhesive agent 9 on the contact surface 7. The adherend 3 is embodied in the mounting plate 2 at a distance 15 to the contact surface 7, resulting in a gap 16 between the contact surface 7 and the wall 8. The distance 15 is measured in particular parallel to a central axis 14 of the mounting plate 2 or perpendicular to the adherend 3. The adherend 3 has an adherend diameter 17. An adhesive not shown here can be injected into the gap 16 via the first mounting opening 11 and/or the second mounting opening 12. Excess adhesive can be absorbed by the groove 6. The adhesive can cure in the gap 16 via the vent openings 10.1, . . . , 10.11 shown in FIG. 1. The groove 6 has a groove width 18. In addition, the mounting plate 2 has a diameter 19 and (parallel to the central axis 14) a length 20.

The device is characterized in particular by high durability to the wall.

LIST OF REFERENCES

1 device
2 mounting plate
3 adherend
4 coating
5 hexagon socket
6 groove
7 contact surface
8 wall
9 adhesive agent
10.1, . . . , 10.11 vent opening
11 first mounting opening
12 second mounting opening
13 end face
14 central axis
15 distance
16 gap
17 adherend diameter
18 groove width
19 diameter
20 length

The invention claimed is:

1. A device (1) for mounting a sanitary component to a wall (8), comprising:

a mounting plate (2), which consists at least partially of plastic and has an adherend (3) for mounting the device (1) to the wall (8); and a metal coating (4), which is formed at least partially on a surface (5) of the adherend (3), wherein an adhesive is applied to the adherend (3) for attaching the device (1) to the wall (8), and wherein the adhesive is either applied to the adherend (3) before the mounting plate (2) is pressed onto the wall (8) or the adhesive is injected through an opening (11, 12) in the mounting plate (2) into a gap (16) between the adherend (3) and the wall (8) and/or onto the adherend (3).

2. The device (1) according to claim 1, wherein the metal coating (4) has a coating thickness of 5 μm to 100 μm.

3. The device (1) according to claim 1, having at least one contact surface (7) for the wall (8), with which the adherend can be positioned at a distance from the wall (8).

4. The device (1) according to claim 3, wherein the contact surface (7) has at least one adhesive agent (9) for pre-attaching the device (1) to the wall (8).

5. The device (1) according to claim 1, wherein the adherend (3) has a plurality of vent openings (10.1, . . . , 10.11).

6. The device (1) according to claim 5, wherein the plurality of vent openings (10.1, . . . 10.11) extend over an area of 5% to 30% of the adherend (3).

7. The device (1) according to claim 5, wherein no point on the adherend (3) has a distance greater than 4 mm from the plurality of vent openings (10.1, . . . , 10.11).

8. The device (1) according to claim 1, wherein the adherend (3) has at least one second mounting opening (12) for mounting the mounting plate (2) to the wall (8).

9. The device (1) according to claim 1, wherein the adherend (3) is at least partially enclosed by a groove (6).

10. The device (1) according to claim 1, wherein the adherend (3) has at least one first mounting opening (11) for the sanitary component.

11. A device (1) for mounting a sanitary component to a wall (8), comprising at least:

a mounting plate (2), which consists at least partially of plastic and has an adherend (3) for mounting the device (1) to the wall (8); and a metal coating (4), which is formed at least partially on a surface (5) of the adherend (3), wherein the adherend (3) is at least partially enclosed by a groove (6).

12. A device (1) for mounting a sanitary component to a wall (8), comprising at least:

a mounting plate (2), which consists at least partially of plastic and has an adherend (3) for mounting the device (1) to the wall (8); and a metal coating (4), which is formed at least partially on a surface (5) of the adherend (3), wherein the adherend (3) has at least one first mounting opening (11) for the sanitary component.

* * * * *